United States Patent [19]

Adkins

[11] Patent Number: 4,494,570

[45] Date of Patent: Jan. 22, 1985

[54] LP GAS SAFETY VALVE

[76] Inventor: Charles H. Adkins, 251 N. Elm, Hagerstown, Ind. 47346

[21] Appl. No.: 472,128

[22] Filed: Mar. 4, 1983

[51] Int. Cl.[3] ..... B67B 7/24

[52] U.S. Cl. ..... 137/590; 137/517; 137/539.5; 137/614.2; 222/3; 222/397

[58] Field of Search ..... 137/590, 543.13, 539.5, 137/517, 613, 614.2; 222/3, 397

[56] References Cited

U.S. PATENT DOCUMENTS

| | | | |
|---|---|---|---|
| 110,082 | 12/1870 | Snyder | 137/543.13 |
| 2,136,163 | 11/1938 | White | 137/517 |
| 2,929,399 | 3/1960 | Magowan, Jr. | 137/517 |
| 3,438,392 | 4/1969 | Wilson | 137/517 |
| 3,648,893 | 3/1972 | Whiting | 137/517 |
| 3,885,589 | 5/1975 | Iung | 137/517 |

*Primary Examiner*—A. Michael Chambers
*Attorney, Agent, or Firm*—Woodward, Weikart, Emhardt & Naughton

[57] ABSTRACT

A fluid flow valve having a rigid tube associated therewith for extending into a tank. In one embodiment, an on-off gas valve includes an extension threadedly mounted thereto with an insert positioned between the extension and valve. A passage extends from the valve through the insert and extension to a rigid tube attached to the extension and a flexible hose attached to the tube. A spring biased safety valve has a stem slidably mounted to the insert and is operable to close the passage in the insert preventing fluid flow. In another embodiment the tube is attached to an insert positioned in the tank passage receiving an on-off valve.

20 Claims, 4 Drawing Figures

LP GAS SAFETY VALVE

BACKGROUND OF THE INVENTION

This invention is in the field of safety valves and more particularly those safety valves combined with LP gas valves. An LP gas on-off valve currently in use and shown in FIG. 1 is manufacture by Rego Company of Chicago, Ill. The valve is removably mounted to an LP gas tank which in turn has an inwardly extending tube welded to the interior of the tank. Considerable difficulty in repairing such a tube is encountered since the valve must first be removed from the tank and then the tube somehow extracted from the tank with a new tube then being subsequently welded to the interior of the tank wall. Such repair is frequently impossible on location or at least considerably difficult by the user of the valve. Disclosed herein is an LP gas on-off valve having a safety valve with the inwardly extending tube being removable from the tank. Thus, the interior welding of the rigid tube is eliminated and the tube may simply be removed from the tank when the on-off valve and safety valve are removed from the tank.

SUMMARY OF THE INVENTION

One embodiment of the present invention is a valve for a tank comprising a valve housing with an inlet, an outlet, a first passage extending therebetween and a closure movably mounted to open and close the passage, an extension threadedly mounted to the outlet and extendable into the tank, a tube attached to the extension and extending into the tank, an insert positioned in the outlet of the housing and having a second passage extending therethrough with a valve seat provided thereon, a rod slidably mounted to the insert and having an enlarged head sealingly seatable upon the valve seat to close the second passage, and spring means operable to bias the head away from the seat in an open position to allow fluid flow from the second passage into the tube but yieldable to allow the head to move to a closed position to seat on the valve seat when the closure inlet is below a predetermined level.

Another embodiment of the present invention is a retrofit safety valve mountable to a fluid valve having an outlet and an inlet in communication together and the closure valve disposed therebetween comprising an extension threadedly mountable to the outlet and extendable into the tank, a tube attached to the extension and extendable into the tank, an insert positionable in the outlet of the housing and having a second passage extending therethrough with a valve seat provided thereon, a rod slidably mounted to the insert and having an enlarged head sealingly seatable upon the valve seat to close the second passage, and spring means operable to bias the head away from the seat in an open position to allow fluid flow from the second passage into the tube but yieldable to allow the head to move to a closed position and seat on the valve seat when the closure is open and pressure in the inlet is below a predetermined level.

Yet another embodiment of the present invention is a port control for a tank wall comprising a valve mount main body attached to the tank wall and having a hole extending therethrough, the hole including internal threads, a removable insert threadedly mounted to the hole and positioned therein, the insert including a passage extending therethrough, a tube attached to the insert and aligned with the passage, the tube extending into the tank when the insert is positioned in the hole, and a valve threadedly mounted to the insert and extending into the hole but being spaced from the insert.

It is an object of the present invention to provide a new and improved fluid flow valve having a safety valve with outlet tube removably attached thereto.

A further object of the present invention is to provide a retrofit safety valve having a tubular outlet removably mountable to an on-off gas valve.

Yet another object of the present invention is to provide a removably mounted tube extendable into an LP gas tank at the location of a valve mounted thereon.

Related objects and advantages of the present invention will be apparent from the following description.

DESCRIPTION OF THE PREFERRED EMBODIMENTS

Figure 1:
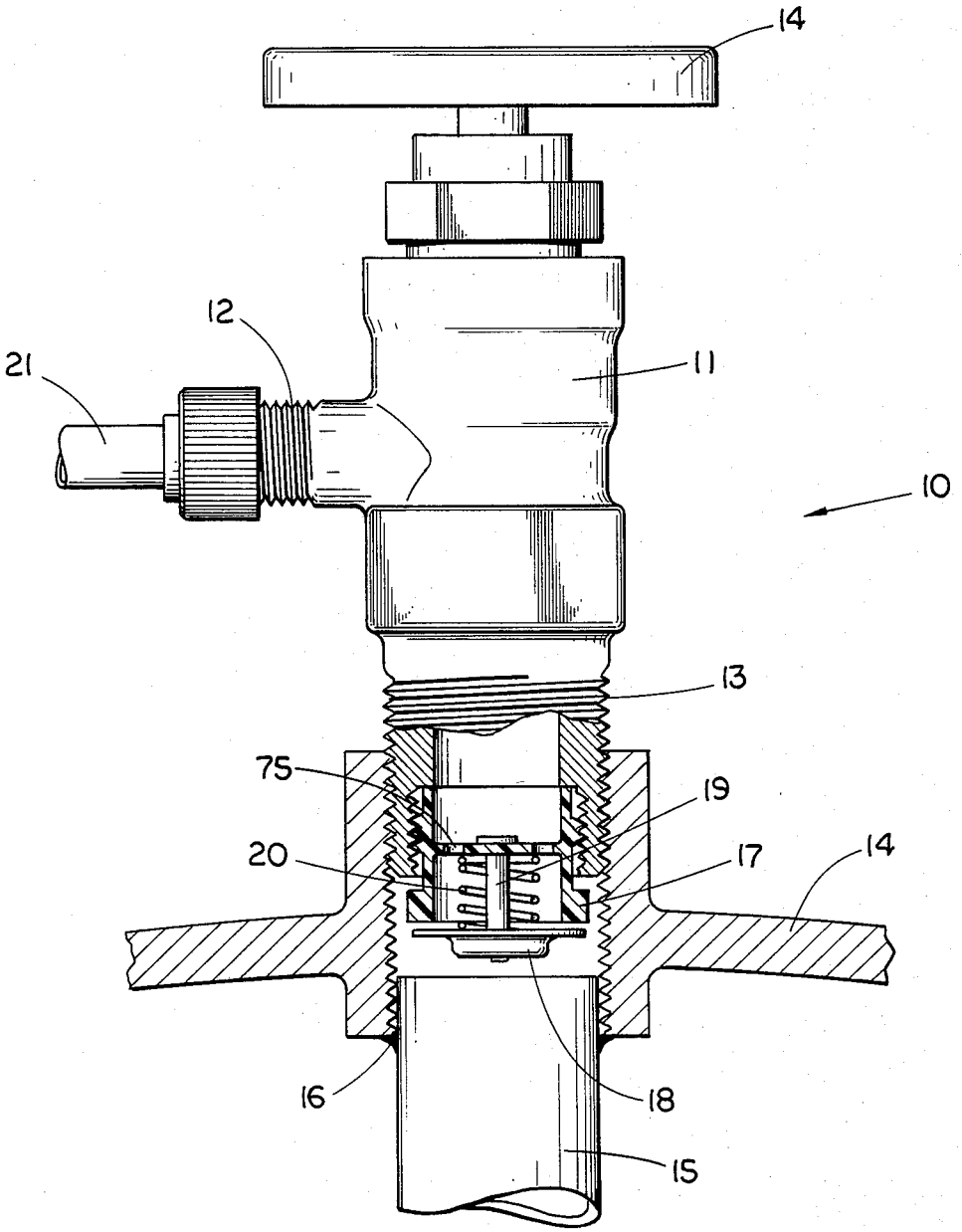
Fig. 1 (PRIOR ART)
FIG. 1 is a fragmentary view of the prior art safety valve shown mounted to a tank.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring more particularly to FIG. 1, there is shown the prior art valve 10 including a main housing 11 with an inlet 12 and outlet 13. An interior passage extends between inlet 12 and outlet 13 with a closure valve positioned therein and operable by handle 14 to open and close the passage thereby controlling fluid flow between the inlet and outlet.

Outlet 13 is threadedly mounted to a tank 14 having a rigid tube 15 fixedly attached by welds 16 to the interior surface of the tank wall. An insert 17 is threadedly mounted to the interior surface of outlet 13 and includes a flat safety valve 18 having a stem 19 mounting the safety valve to the insert. A helical spring 20 normally forces flat valve 18 towards tube 15. A plurality of passages 75 extend through insert 17 allowing fluid flow normally from outlet 13 towards tube 15. In the event hose 21 is accidentally cut interrupting the flow of gas to inlet 12, atmospheric pressure will exist at inlet 12 normally allowing the pressurized gas in tank 14 to escape through valve housing 11 assuming the interior closure within housing 11 is in the open condition. Thus, flat valve 18 acts as a safety valve automatically closing the passages 75 extending through insert 17 and preventing fluid flow of the pressurized gas within tank 14 outwardly therefrom thereby effectively preventing fluid flow from outlet 13 to inlet 12.

It can be appreciated that if tube 15 is damaged, that it is exceedingly difficult to repair the tube due to the manner of attachment of the tube to the interior surface of tank 14. Thus, I have designed the valve shown in FIG. 2. Valve 30 includes a valve housing 31 with an inlet 32, an outlet 33 and a passage 34 extending therebetween. A conventional on-off valve 35 controlled by handle 36 is operable to allow or prevent fluid flow in passage 34. Outlet 33 includes external threads 36 threadedly mounted to tank wall 37 preventing fluid flow between the exterior surface of the valve outlet and the tank wall.

Extension 38 includes end 39 having exterior threads thereon in meshing engagement with interior threads 40 provided within outlet 33. Extension 38 extends into the tank and has rigid tube 41 fixedly attached thereto by welds 42. Insert 43 is positioned within outlet 33 and has a passage 44 extending centrally therethrough allowing fluid flow from outlet 33 to passage 45 of extension 38 and then into tube 41.

Safety valve 46 includes enlarged head 47 fixedly mounted to stem 48 slidably mounted in passage 44. The diameter of stem 48 is sufficiently smaller than the diameter of passage 44 in order to allow fluid flow between the stem and passage wall. Insert 43 has a reduced diametered end 49 extending into a conventional helical spring 50 engaging at its opposite end enlarged head 47. The enlarged head is spherical in configuration and will sealingly seat in valve seat 51 provided in end 49 of insert 43 with the valve seat surrounding passage 44.

Figure 3:
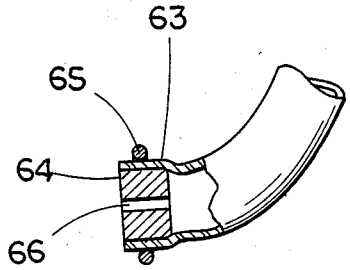
FIG. 3 is an end view of the safety valve looking in the direction of arrows 3—3 of FIG. 2.
Figure 3:
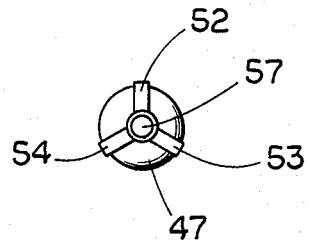

The spherical enlarged head 47 (FIG. 3) includes three ribs 52, 53 and 54 extending outwardly towards tube 41. The ribs are spaced 120° apart and engage the end surface 55 of extension 38 thereby spacing the enlarged head apart from the interior surface of the extension and allowing fluid flow from passage 44 through passage 45 and exiting through extension outlet 56 into which tube 41 extends.

Head 47 further includes a recess or cavity 57 facing tube 41 and positioned to receive the fluid flow from tube 41 against head 47 thereby directing the fluid flow force along a line equal to the axis of stem 48 to compress spring 50.

Figure 2:
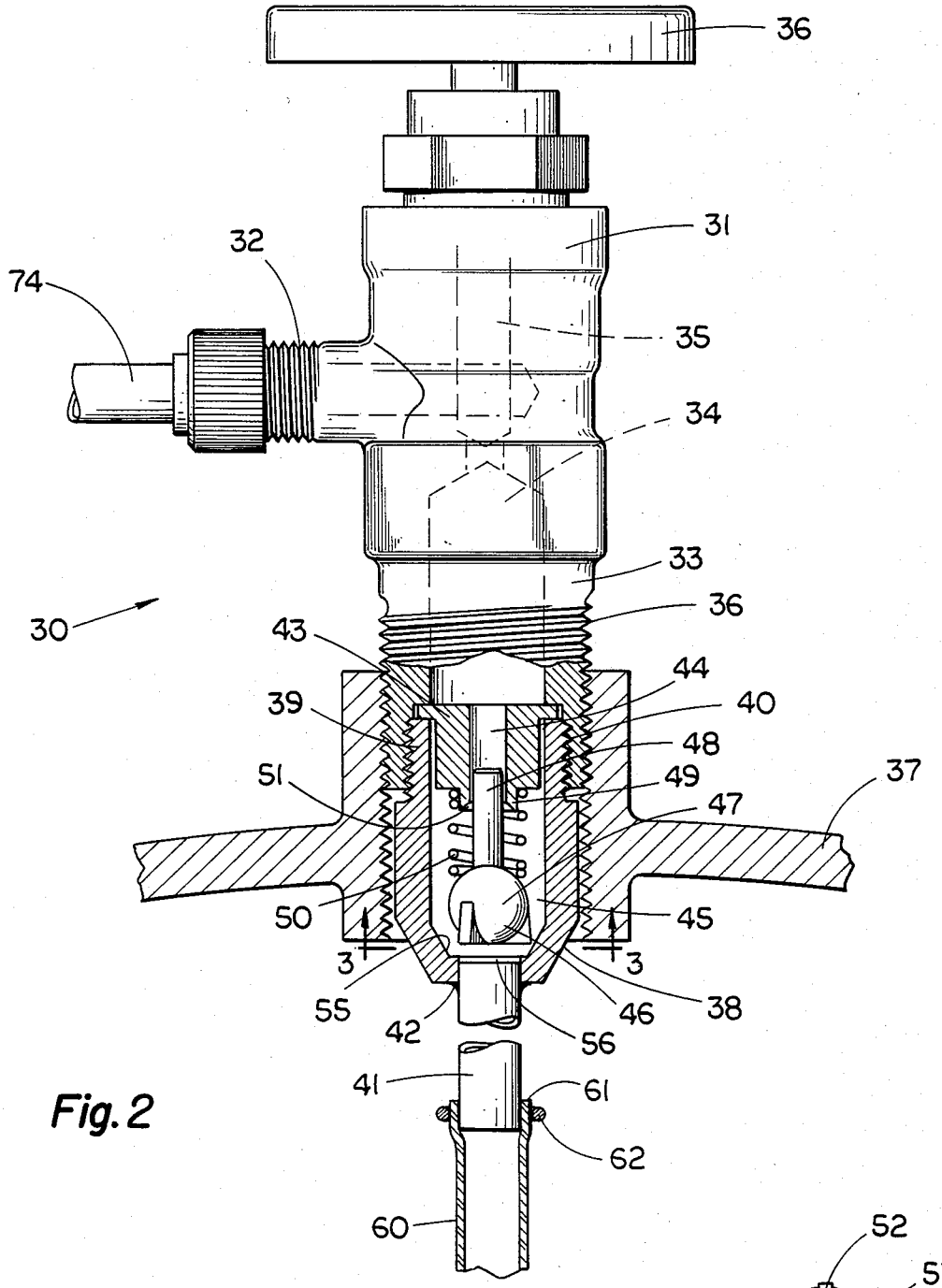
FIG. 2 is a fragmentary view of an on-off gas valve with attached safety valve incorporating my new invention.

Enlarged head 47 is normally positioned as shown in FIG. 2 with fluid flowing in the direction from outlet 33 toward tube 41. Likewise, enlarged head 47 will be positioned as shown in FIG. 2 with reverse fluid flow from tube 41 toward outlet 33 assuming closure 35 is in the open position and inlet 32 is connected to a source of pressurized gas greater than atmospheric pressure. In the event hose 74 is cut or damaged thereby allowing atmospheric pressure to be present at inlet 32 and further assuming closure 35 is in the open position, then fluid flow from tube 41 will impact recess 57 causing enlarged head 47 to move and sealingly abut seat 51 thereby shutting off the flow. In the event handle 36 is turned to move closure 35 to the closed position thereby preventing fluid flow in passage 34, then enlarged head 47 will be positioned once again as shown in FIG. 2.

A flexible hose 60 positioned within the tank has a first end 61 removably attached by ring 62 or other conventional fastener to the distal end of tube 41. The opposite end 63 of hose 60 includes a weight 64 positioned therein and secured thereto by means of a ring 65 or other conventional fastening device. Weight 64 includes a passage 66 extending centrally therethrough allowing fluid flow into and out of hose 60. Weight 64 is operable to cause hose 60 to extend downwardly into the tank.

Figure 4:
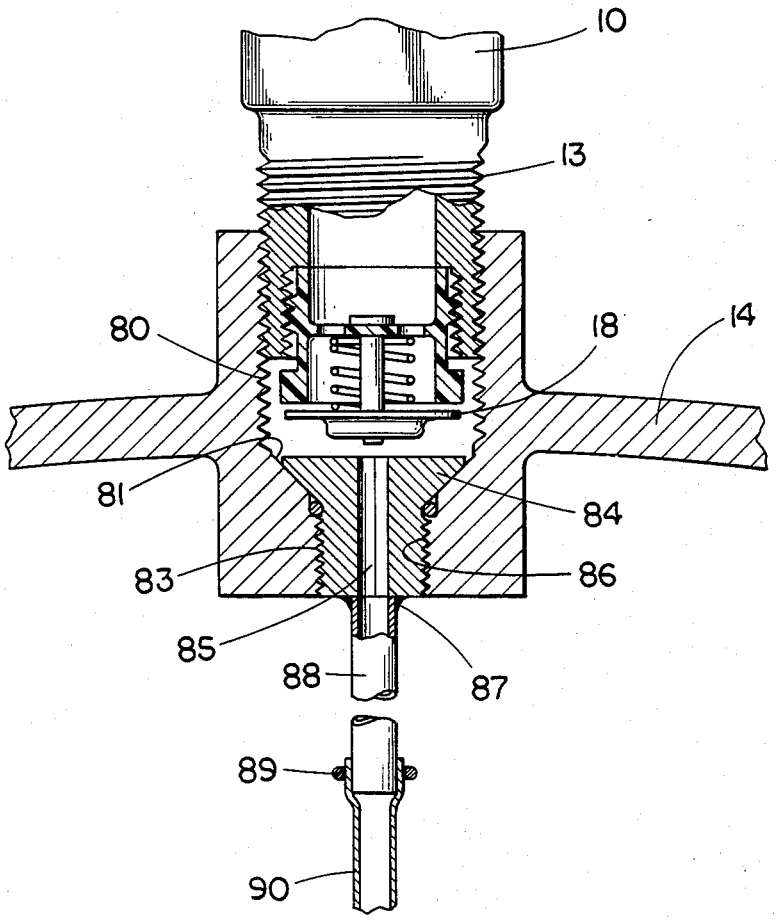
FIG. 4 is a fragmentary cross-sectional view of the preferred embodiment of the present invention having an insert with attached tube removably mounted to the tank at the same location as the prior art valve shown in FIG. 1.

The preferred embodiment of the invention is shown in FIG. 4. The conventional on-off gas valve 10 of FIG. 1 is threadedly received in hole 80 provided in tank wall 14. Valve 10 is identical to the valve in FIG. 1 previously described in this application and only a portion thereof is shown for purposes of clarity. Hole 80 is aligned with and in communication with a smaller diametered hole 83 with a continuous converging surface 81 extending from the larger diametered hole 80 to the smaller diametered hole 83. A removable insert 84 is threadedly mounted to hole 83 and is positioned therein. Insert 84 includes a passage 85 extending therethrough to receive fluid flow from outlet end 13 of valve 10. A rigid tube 88 is fixedly attached by welds 87 to insert 84 and has a flexible hose 90 attached to the distal end of tube 88 by a conventional ring fastener 89. Hose 90 is identical to the flexible hose shown attached to the rigid tube in FIG. 1 and also has a weighted bottom end to direct the outlet of hose 90 towards the bottom of the tank. Tube 88 is aligned with passage 85 which has a polygonal cross-section to receive a complementary shaped removal tool shank to assist in removing the insert.

Insert 84 is sealed to the surface 81 by means of an O-ring seal mounted to insert 84 and positioned between surface 81 and hole 83. The threads 86 of insert 84 are in meshing engagement with the internal threads of hole 83.

In the event tube 88 becomes damaged, valve 10 is first unscrewed from hole 80. Next, a wrench having a polygonal shaped shank is inserted into the complementary shaped hole 85 and turned thereby unscrewing insert 84 from hole 83 and allowing removal of tube 88. A new insert with tube is then inserted and valve 10 is installed.

The safety valve disclosed herein is particularly advantageous for use with LP gas tanks mounted to lift trucks, mobile homes and campers. The structure disclosed herein allows easy access for repairing the dip tube located within the tank. It will be obvious from the above description that the present invention provides a new and improved safety valve for use with an LP gas valve.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A valve for a tank comprising:

a valve housing with an inlet, an outlet, a first passage extending therebetween and a closure movably mounted to open and close said passage;

an extension threadedly mounted to said outlet and extendable into said tank;

a tube attached to said extension and extending into said tank;

an insert positioned in said outlet of said housing and having a second passage extending therethrough with a valve seat provided thereon;

a rod slidably mounted to said insert and having an enlarged head sealingly seatable upon said valve seat to close said second passage; and, spring means operable to bias said head away from said seat in an open position to allow fluid flow from said second passage into said tube but yieldable to allow said head to move to a closed position to seat on said valve seat when said closure inlet is below a predetermined level.

2. The valve of claim 1 wherein:

said rod includes spacing means operable when said head is in said open position to contact said extension spacing said head therefrom allowing fluid flow into said tube.

3. The valve of claim 2 wherein:

said enlarged head includes a recess facing said tube to direct fluid force through said head against said spring when fluid flows from said tube to said inlet.

4. The valve of claim 3 and further comprising:

a flexible hose connected at one end to said tube and having an opposite weighted end extending downwardly into said tank.

5. The valve of claim 4 wherein:

said insert includes a flange extending transversely thereof with said extension contacting said flange abutting said insert against said valve housing and limiting relative motion between said valve housing and said insert.

6. The valve of claim 5 wherein said insert includes a reduced diameter end extending into and holding said spring means which is a helical spring engaging at its opposite end said enlarged head.

7. The valve of claim 6 wherein said extension and said inlet include respectively external and internal threads in meshing engagement releasably securing said extension and housing together.

8. The valve of claim 7 wherein said tube is rigid and is welded to said extension.

9. A retrofit safety valve mountable to a fluid valve having an outlet and an inlet in communication together and a closure valve disposed therebetween comprising:

an extension threadedly mountable to said outlet and extendable into said tank;

a tube attached to said extension and extendable into said tank;

an insert positionable in said outlet of said housing and having a second passage extending therethrough with a valve seat provided thereon;

a rod slidably mounted to said insert and having an enlarged head sealingly seatable upon said valve seat to close said second passage; and, spring means operable to bias said head away from said seat in an open position to allow fluid flow from said second passage into said tube but yieldable to allow said head to move to a closed position and seat on said valve seat when said closure is open and pressure in said inlet is below a predetermined level.

10. The valve of claim 9 wherein:

said rod includes spacing means operable when said head is in said open position to contact said extension forcing said head therefrom allowing fluid flow into said tube.

11. The valve of claim 10 wherein:

said enlarged head includes a recess facing said tube to direct fluid force through said head against said spring when fluid flows from said tube to said inlet.

12. The valve of claim 11 and further comprising:

a flexible hose connected at one end to said tube and having an opposite weighted end extending downwardly into said tank.

13. The valve of claim 12 wherein:

said insert includes a flange extending transversely thereof with said extension contacting said flange abutting said insert against said valve housing and limiting relative motion between said valve housing and said insert.

14. A port control for a tank wall comprising:

a valve mount main body attached to said tank wall and having a hole extending therethrough, said hole including internal threads;

a removable insert threadedly mounted to said hole and positioned therein, said insert including a passage extending therethrough;

a tube attached to said insert and aligned with said passage, said tube extending into said tank when said insert is positioned in said hole;

a valve threadedly mounted to said insert and extending into said hole but being spaced from said insert; and wherein:

said hole includes a large diametered end receiving said valve and a smaller diametered end threadedly receiving said insert with said hole having a continuous surface decreasing in diameter therebetween, said insert including an O-ring seal thereon sealingly engaging said surface.

15. The port control of claim 14 wherein said passage has a polygonal cross-sectional configuration to receive a removal tool shank.

16. The port control of claim 15 and further comprising:

a flexible hose connected at one end to said tube and having an opposite weighted end extending downwardly into said tank.

17. A removable tube for inserting into an LP gas tank comprising:

a removable insert to threadedly screw into said tank and including a passage extending therethrough;

a tube attached to said insert and aligned with said passage, said tube extending into said tank when said insert is screwed into said tank; and wherein said insert includes an O-ring seal thereon sealingly engaging said tank, said insert has an enlarged head and a reduced diametered externally threaded shank with said O-ring located therebetween.

18. The tube of claim 17 wherein:

said passage has a polygonal cross-sectional configuration to receive a removal tool shank.

19. A removable tube for inserting into an LP gas tank comprising:

a removable insert to threadedly screw into said tank and including a passage extending therethrough;

a tube attached to said insert and aligned with said passage, said tube extending into said tank when said insert is screwed into said tank; and wherein:

said insert has an enlarged head located completely within said removable insert and a reduced diametered externally threaded shank threadedly extending through said passage with said insert sealingly engaging said tank.

20. The tube of claim 19 wherein said passage has a polygonal cross-sectional configuration to receive a removal tool shank.

* * * * *